US006192731B1

(12) United States Patent
Toivanen

(10) Patent No.: US 6,192,731 B1
(45) Date of Patent: Feb. 27, 2001

(54) METHOD FOR FORMING SHEET METAL STRIP

(75) Inventor: Tuomo Toivanen, Kuopio (FI)

(73) Assignee: Suunnittelutoimisto Tuomo Toivanen Oy, Kuopio (FI)

( * ) Notice: Subject to any disclaimer, the term of this patent is extended or adjusted under 35 U.S.C. 154(b) by 0 days.

(21) Appl. No.: 09/383,389

(22) Filed: Aug. 26, 1999

(30) Foreign Application Priority Data

Feb. 28, 1997 (FI) ..... 970873

(51) Int. Cl.[7] ..... B21D 13/06

(52) U.S. Cl. ..... 72/307; 72/309; 72/308; 72/379.6

(58) Field of Search ..... 72/379.6, 385, 72/177, 311, 308, 307, 285, 309

(56) References Cited

U.S. PATENT DOCUMENTS

| | | | | |
|---|---|---|---|---|
| 4,250,728 | | 2/1981 | King | 72/177 |
| 4,444,037 | | 4/1984 | Norgate | 72/177 |
| 4,528,835 | | 7/1985 | Ekmark | 72/379 |

FOREIGN PATENT DOCUMENTS

| | | | | |
|---|---|---|---|---|
| 0 465 445 | | 3/1994 | (EP) . | |
| 99284 | | 1/1962 | (NO) . | |
| 871883 | * | 10/1981 | (RU) | 72/379.2 |
| 447 146 | | 10/1986 | (SE) . | |
| WO 81/02121 | * | 8/1981 | (WO) | 72/379.6 |

* cited by examiner

*Primary Examiner*—Daniel C. Crane
(74) *Attorney, Agent, or Firm*—Pillsbury Winthrop LLP

(57) ABSTRACT

The subject of the invention is a method for forming sheet metal strip, such as roofing sheets, in which the sheet strip (1) is moved forward and formed into undulated metal sheets by means of machine tools (2). The tooling (2) used in the method according to the invention consists of one or more presses (2) which are fitted with undulated pressing dies. The sheet metal strip (1) is gripped in place with the second press (3) and, when secured, the first press (22) is drawn along the length of the sheet metal strip and forms, by means of the press, an undulate profile (4) in the sheet metal strip.

3 Claims, 2 Drawing Sheets

METHOD FOR FORMING SHEET METAL STRIP

Figure 1:
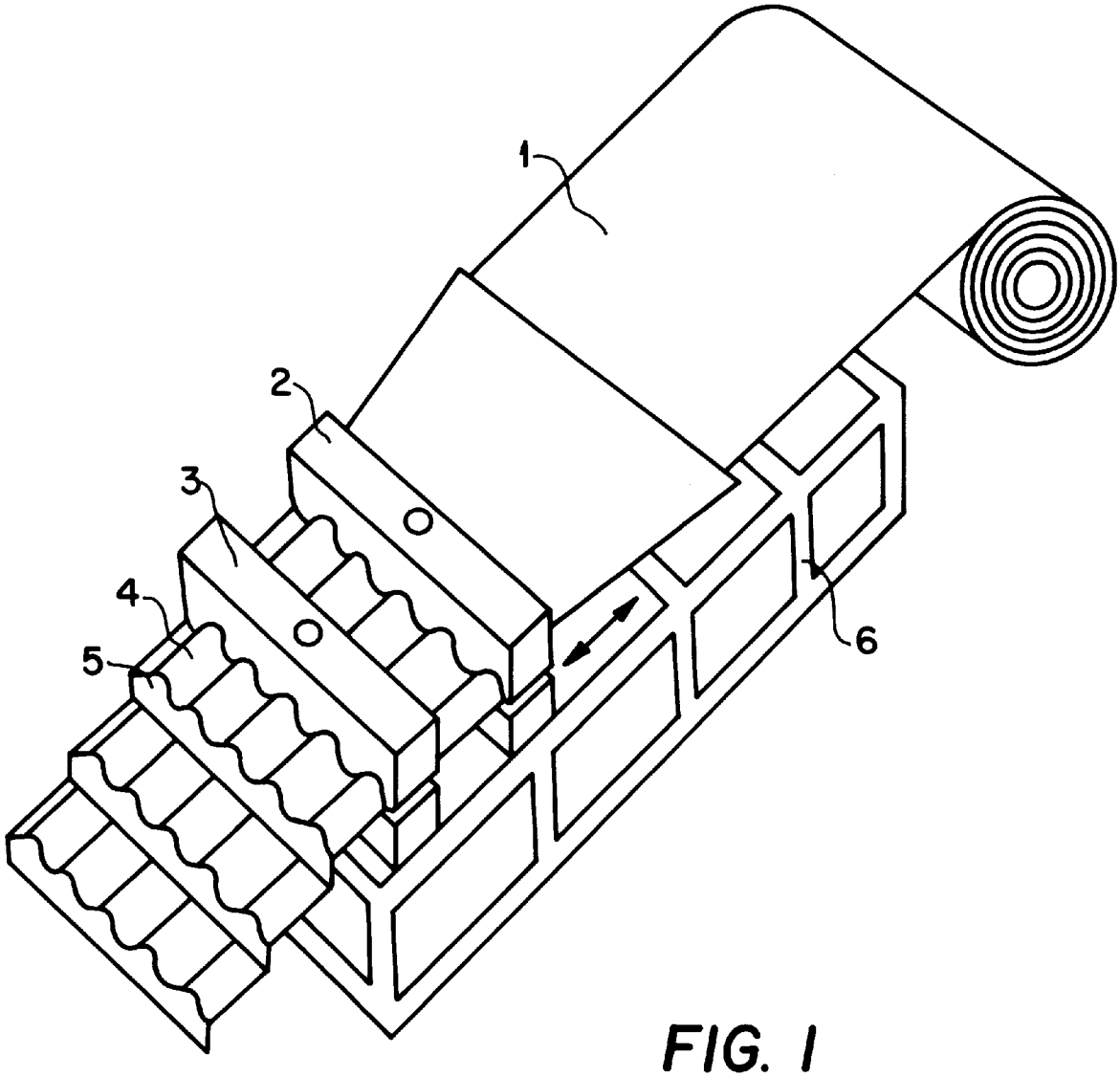

The subject of the invention is a method for forming sheet metal strip, such as roofing sheets, in which the sheet strip is moved forward and formed into undulated metal sheets by means of machine tools.

It is an established process to form undulated profiles in metal sheets, which are typically used in construction, for example, as roof sheeting. With current methods and machinery the sheets are formed by moving the sheet metal forward along the bed of the equipment and by pressing during the moving stage, using the machine's rollers or wheels, on the sheet metal surface from different sides such that an undulated profile is achieved.

There are several drawbacks associated with the current method and the machinery used in it. The construction of the machinery is complex, large scale and expensive. It requires, for example, expensive length measuring devices, forming rolls, various axles, bearings, chains, etc. In addition, this type of machinery requires a stable electrical voltage supply in order to function, nor does it function reliably in conditions where the electrical voltage supply fluctuates.

The purpose of this invention is to introduce a method for forming sheet metal strip which removes the drawbacks associated with current methods and machinery. In particular, the purpose of this invention is to introduce a method which does not require the present complex machinery when in use, rather the machinery used for this method is of a relatively simple construction. In addition, the purpose of this invention is to introduce a method that can also be used in poor conditions and functions reliably. In addition, the purpose of this invention is to introduce a method that is simple to use, which can be used and adapted to various electrical voltage supplies and where there is general availability of spare parts for the machinery used.

The purpose of the invention is achieved with a method that possesses the characteristics presented in the appended claims.

The tooling used in the method according to the invention consists of one or more presses, which are fitted with undulated pressing dies. The sheet metal strip is gripped in place with the second press and when secured, the first press is drawn along the length of the sheet metal strip and forms, by means of the press, an undulated profile in the sheet metal strip. In the method according to the invention the sheet metal strip is held in position during the working stage and the press travels along its length. The surfaces of the press which are in contact with the metal sheet are suitably shaped so that when they are drawn along the metal sheet an undulated profile is formed.

In the next advantageous stage of the method according to the invention, the first press is clamped tight against the sheet metal strip after the drawing stage, then the second pressing tool is released from the sheet metal strip and the first press and the sheet metal strip are moved towards the second press. In this way, the machinery used for the method does not need any other transfer equipment and the machinery is simple in construction and economical.

In the next advantageous stage of the method according to the invention, when the first press is moved to its starting position, it is released from the sheet metal strip and with the second pressing tool, a stepped profile is pressed into the sheet metal strip in the direction of length of the strip. The strip is profiled with this second press in the other direction. This second press is used to grip the metal strip when the first press is drawn in the direction of the metal strip.

The method and machinery according to the invention are simple in terms of function and construction, and can be economically produced. They are also suitable for use in poor conditions, since the machinery can be operated using hydraulically driven press tools rather than electrical equipment. The machinery does not require expensive length measuring equipment nor complex and expensive control equipment, forming rolls or equivalent. Measurement can be carried but by controlling with hydraulic limit switches. The machinery is reliable, simple to use, simple to service, and spare parts for it can be found throughout the world. In addition, the total length of the machine is noticeably shorter than in previous machines and the bed length can be, for example, about 115th of the length of previous machinery.

Figure 2:
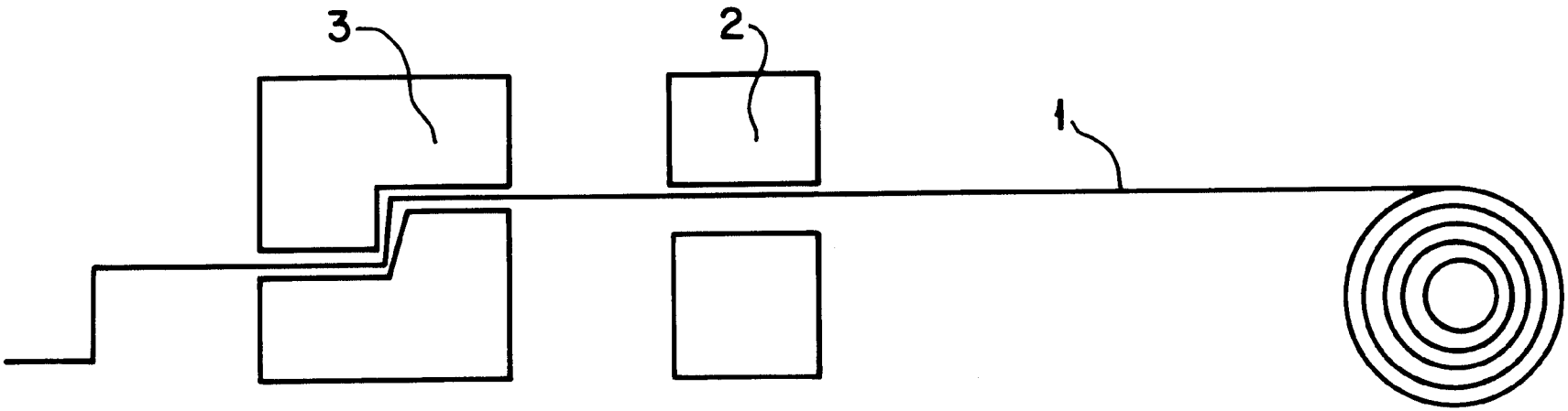

In the following the invention is explained in more detail with reference to the attached illustrations, in which:

FIG. 1 shows machinery suited to the method according to the invention, viewed from an angle, and FIG. 2 shows the machinery in FIG. 1, diagrammatically presented and viewed from the side.

The machinery according to FIGS. 1 and 2 includes the bed 6, on which is situated the first press 2 and the second press 3. The sheet metal strip 1 is on a roll some distance away from the bed or as a support to the bed. The first press 2 can travel on the bed in a lengthways direction, but the actual transfer equipment is not shown in the figure. This pressing tool 2 includes two opposite pressing tools that are fitted with undulated dies.

Some distance away from the first pressing tool 2 is the second pressing tool 3 which is fixed to the bed. It is also fitted with a pair of pressing tools, but with this tool a step is pressed into the metal sheet.

When using the method according to the invention, the end of the metal sheet 1 is passed through the press 2 and on to press 3. The press 3 grips the strip in position and the press 2 is drawn along the length of the strip. The pressing dies of press 2 are pressed against each other such that the strip is pressed between them and an undulated profile 4 is formed in the strip. The press 2 is moved some distance away, pressing against the metal strip and when at a suitable distance, for example 1–1.5 meters, the press is stopped. After this, the latter pressing tool 3 is released and the press 2 and the metal strip are moved forward towards the second pressing tool until the press 2 is in its starting position. After this a stepped longitudinal profile 5 is made in the metal strip with the latter press 3. The procedure is then repeated.

The invention is not limited to the advantageous arrangements shown but can vary within the framework of the invention concept formed by the claims.

What is claimed is:

1. A method for forming a sheet metal strip, comprising:

advancing the sheet metal strip toward at least one machine tool including first and second presses, the first press defining an undulated pressing die;

securing the sheet metal strip with the second press; and when the sheet metal strip is secured with the second press, drawing the first press along a length of the sheet metal strip to form an undulated profile in the sheet metal strip using the undulated pressing die of the first press.

2. A method according to claim 1, further comprising:

after drawing, gripping, the sheet metal strip with the first press;

releasing the second press from the sheet metal strip; and advancing the first press and sheet metal strip towards the second press.

3. A method according to claim 2, further comprising:

after advancing the first press to its starting position, releasing the first press from pressing the sheet metal strip; and pressing a stepped profile into the sheet metal strip along the length of the sheet metal strip using the second press.

* * * * *